US007013500B1

(12) United States Patent
Lin

(10) Patent No.: US 7,013,500 B1
(45) Date of Patent: Mar. 21, 2006

(54) STRAINER

(76) Inventor: Kun-Hsi Lin, No. 183, Jiangong Rd., East District, Taichung City (TW)

( * ) Notice: Subject to any disclaimer, the term of this patent is extended or adjusted under 35 U.S.C. 154(b) by 0 days.

(21) Appl. No.: 11/002,261

(22) Filed: Dec. 3, 2004

(51) Int. Cl.
*A47K 1/14* (2006.01)
*E03C 1/26* (2006.01)

(52) U.S. Cl. ..... 4/287; 4/288; 4/290; 4/295

(58) Field of Classification Search ..... 4/688, 4/689, 287, 288, 290, 292, 295; 210/163
See application file for complete search history.

(56) References Cited

U.S. PATENT DOCUMENTS 1,760,659 A * 5/1930 Pasman ..... 4/287
1,763,864 A * 6/1930 Robertson ..... 4/289
1,773,547 A * 8/1930 Robertson ..... 4/287
1,811,852 A * 6/1931 Judell ..... 4/287
1,956,654 A * 5/1934 Pope ..... 4/287
1,975,865 A * 10/1934 Rabinovich ..... 4/287
2,090,299 A * 8/1937 Kuhnle ..... 4/287
2,107,126 A * 2/1938 Pasman ..... 4/291
2,112,834 A * 4/1938 Egan ..... 4/287
2,163,453 A * 6/1939 Schultis ..... 4/287
2,188,613 A * 1/1940 Reedy ..... 4/287
2,197,083 A * 4/1940 Schaible ..... 4/287
2,225,693 A * 12/1940 Frances ..... 285/348
2,236,885 A * 4/1941 Zinkil et al. ..... 4/287
2,278,566 A * 4/1942 Schaible ..... 285/148.11
2,279,683 A * 4/1942 Judell et al. ..... 4/288
2,296,527 A * 9/1942 Kuhnle ..... 4/287
2,450,392 A * 9/1948 Donahue ..... 4/287
2,450,393 A * 9/1948 Donahue ..... 4/287
2,464,018 A * 3/1949 Bloch ..... 4/287
2,500,674 A * 3/1950 Gleason ..... 4/287
2,544,498 A * 3/1951 Hiertz ..... 4/287
2,569,615 A * 10/1951 Link ..... 4/287
2,617,997 A * 11/1952 Hiertz ..... 4/287
2,662,230 A * 12/1953 Borman ..... 4/287
2,668,962 A * 2/1954 Spector ..... 4/287
2,736,040 A * 2/1956 Mackey ..... 4/287
2,736,577 A * 2/1956 Mackey ..... 285/139.3
2,739,317 A * 3/1956 Abresch ..... 4/679
2,763,012 A * 9/1956 Duncan ..... 4/287
2,838,769 A * 6/1958 Lengyel ..... 4/287
2,890,463 A * 6/1959 Young ..... 4/287
3,220,695 A * 11/1965 Jones et al. ..... 251/263

(Continued)

*Primary Examiner*—Robert James Popovics
*Assistant Examiner*—T. Woodruff
(74) *Attorney, Agent, or Firm*—Birch, Stewart, Kolasch & Birch, LLP

(57) ABSTRACT

A strainer includes a water collector on an upper side, and a tube coupled on the bottom of the water collector. The tube has flutes formed on the inner wall. An extendable rod is housed in the tube and has lugs on the periphery to slide in the flutes. A latch member is housed in a housing chamber on the bottom of the extendable rod and has coupling sections formed on the bottom in an annular manner. An elastic element has a top end housed in the latch member and a bottom end fastened to a coupling member to couple on the bottom end of the tube. The top end of the extendable rod is fastened to a plug which is insertable in the drain port of the water collector. A filter is located in the water collector and has a button in the center depressible up and down to control water collection or discharge.

4 Claims, 7 Drawing Sheets

U.S. PATENT DOCUMENTS 3,308,484 A * 3/1967 Povalski ..... 4/287
3,333,815 A * 8/1967 Jones et al. ..... 251/263
3,428,295 A * 2/1969 Jones et al. ..... 251/263
3,588,928 A * 6/1971 Hiertz ..... 4/287
3,596,294 A * 8/1971 Hoffman ..... 4/287
3,700,381 A * 10/1972 Deeke ..... 4/288
3,711,874 A * 1/1973 Gajer ..... 4/287
3,777,320 A * 12/1973 Politz ..... 4/287
3,800,339 A * 4/1974 Bergin ..... 4/287
3,802,001 A * 4/1974 Richards ..... 4/287
3,813,708 A * 6/1974 Hamburg ..... 4/286
3,911,508 A * 10/1975 Goldberg ..... 4/287
3,982,289 A * 9/1976 Robbins ..... 4/292
4,232,407 A * 11/1980 Williams ..... 4/287
4,276,662 A * 7/1981 Young ..... 4/295
4,320,540 A * 3/1982 Leavens ..... 4/287
4,359,788 A * 11/1982 Liou ..... 4/287
4,586,203 A * 5/1986 Westgerdes ..... 4/287
4,692,948 A * 9/1987 Martin ..... 4/286
4,706,306 A * 11/1987 Smith ..... 4/286
4,860,390 A * 8/1989 Ohta ..... 4/295
5,165,118 A * 11/1992 Cendrowski ..... 4/287
5,265,281 A * 11/1993 McAlpine ..... 4/287
5,369,815 A * 12/1994 Martin ..... 4/287
5,418,983 A * 5/1995 Garguillo et al. ..... 4/287
5,535,455 A * 7/1996 Liu ..... 4/287
6,058,526 A * 5/2000 Parisi et al. ..... 4/688
6,108,828 A * 8/2000 Cheng ..... 4/287
6,195,819 B1 * 3/2001 Wang ..... 4/689
2003/0182721 A1 * 10/2003 Li ..... 4/287
2004/0073992 A1 * 4/2004 Saman et al. ..... 4/287

* cited by examiner

STRAINER

FIELD OF THE INVENTION

The present invention relates to a strainer and particularly to a sink strainer having a button in the center of a filter that is depressible to control water collection and discharge.

BACKGROUND OF THE INVENTION

A conventional strainer for kitchen sinks (referring to FIGS. 1 and 2) generally includes a hollow barrel 1 which has a funnel shape opening 2 with a larger diameter at the upper side and a smaller diameter at the lower side. The barrel 1 has an outer wall screwed on the bottom of the sink and a plurality of apertures 3 formed on the bottom thereof leading to a discharge tube beneath the sink. The barrel 1 has a rectangular anchor bore 4 in the center of the bottom. A disk type filter 5 made of metal is provided with filter holes 6 formed on the bottom and peripheral wall. There is a handle 7 located on the top of the center of the filter 5. The bottom of the filter 5 is coupled with a plug 8 made of rubber to stop water flow. The plug 8 has a flattened insertion strut 9 on the bottom to couple with the anchor bore 4.

When in use for stopping water discharge, insert the insertion strut 9 into the anchor bore 4 and depress, the plug 8 seals the lower side of the funnel opening 2 so that water is blocked from flowing out through the apertures 3 (referring to FIG. 2). For the filter 5 to provide filter function, pull the handle 7 upwards, and turn an angle to make the lower shoulder of the insertion strut 9 resting transversely on the anchor bore 4, the plug 8 is lifted to form a gap with the bottom of the funnel opening 2, water collected in the sink may be discharged through the filter holes 6 into the discharge tube beneath the barrel 1. In such a strainer structure, to stop water discharge through the filter 5, user has to depress downwards forcefully. To clear the residues trapped in the filter 5, the filter 5 has to be lifted and water is taken as well. As a result, the floor and sink counter often are splashed with water, and a portion of the residues could drop into the discharge tube with the water and accumulate and clog the discharge tube after a period of time. There is still room for improvement.

SUMMARY OF THE INVENTION

In view of the aforesaid disadvantages, the primary object of the present invention is to provide a strainer with a button in the center of a filter that is depressible to control water collection or discharge.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
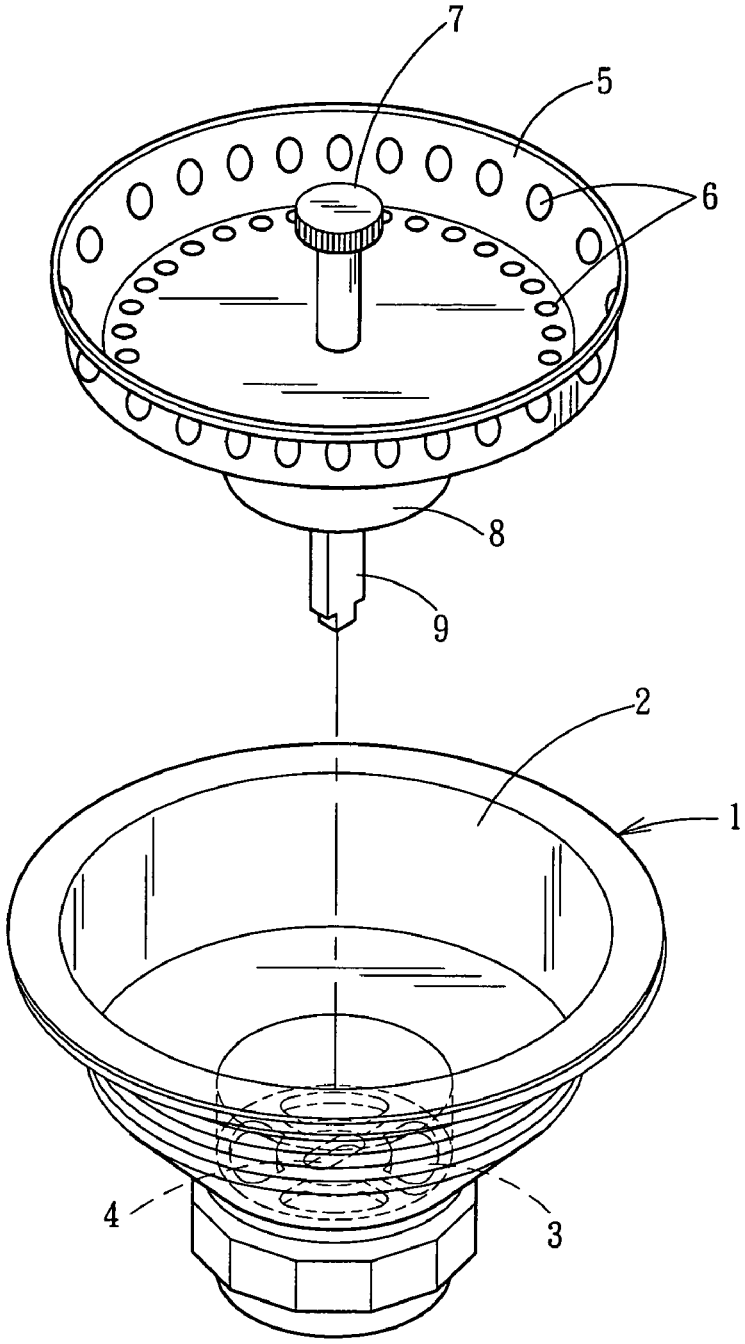
Fig. 1 PRIOR ART
FIG. 1 is an exploded view of a conventional strainer.
Figure 2:
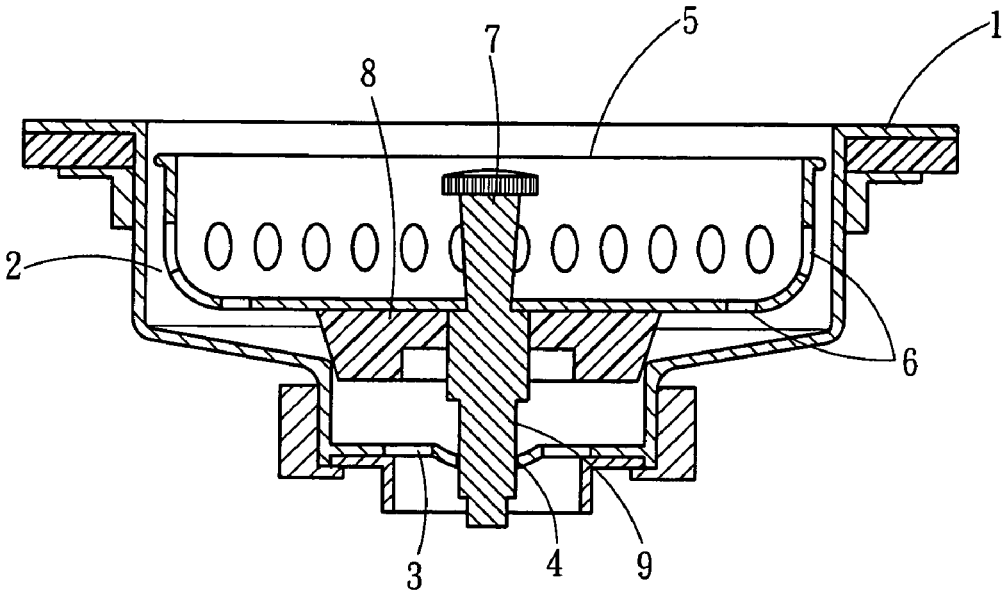
Fig. 2 PRIOR ART
FIG. 2 is a perspective view of a conventional strainer.
Figure 3:
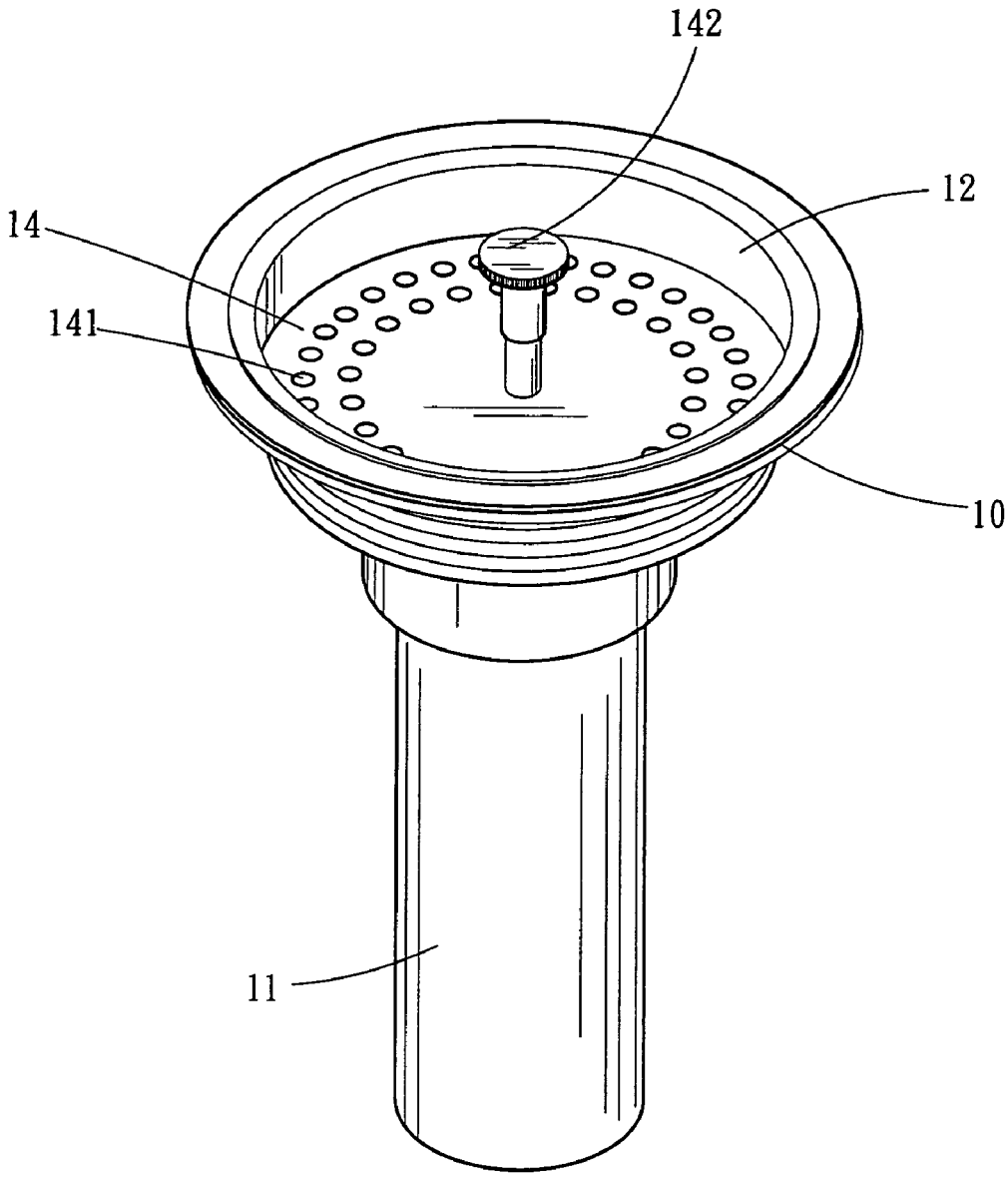
FIG. 3 is a perspective view of an embodiment of the present invention.
Figure 4:
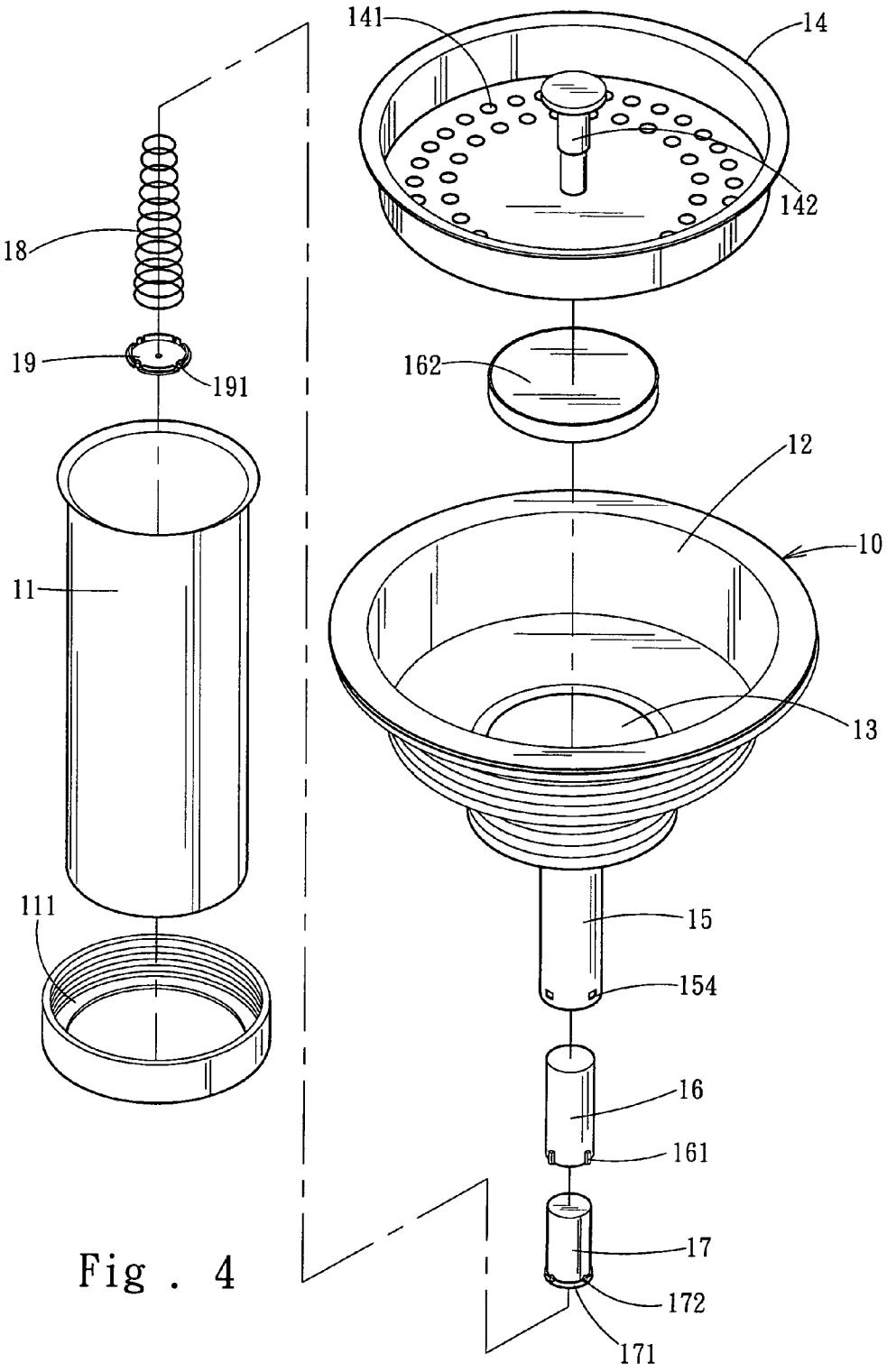
FIG. 4 is an exploded view of an embodiment of the present invention.

Please refer to FIGS. 3 and 4, the strainer 10 according to the present invention includes a trumpet shape body with screw threads on the bottom to couple with a screw sleeve 111 of a duct 11, and a water collector 12 on a upper side that has a round opening directing upwards. The water collector 12 has a drain port 13 on the bottom.

A filter 14 is provided which is formed like a tray with a perimeter mating the water collector 12. The filter 14 has a plurality of drain apertures 141 on the bottom and a button 142 formed in a strut running through the center thereof.

Figure 5A:
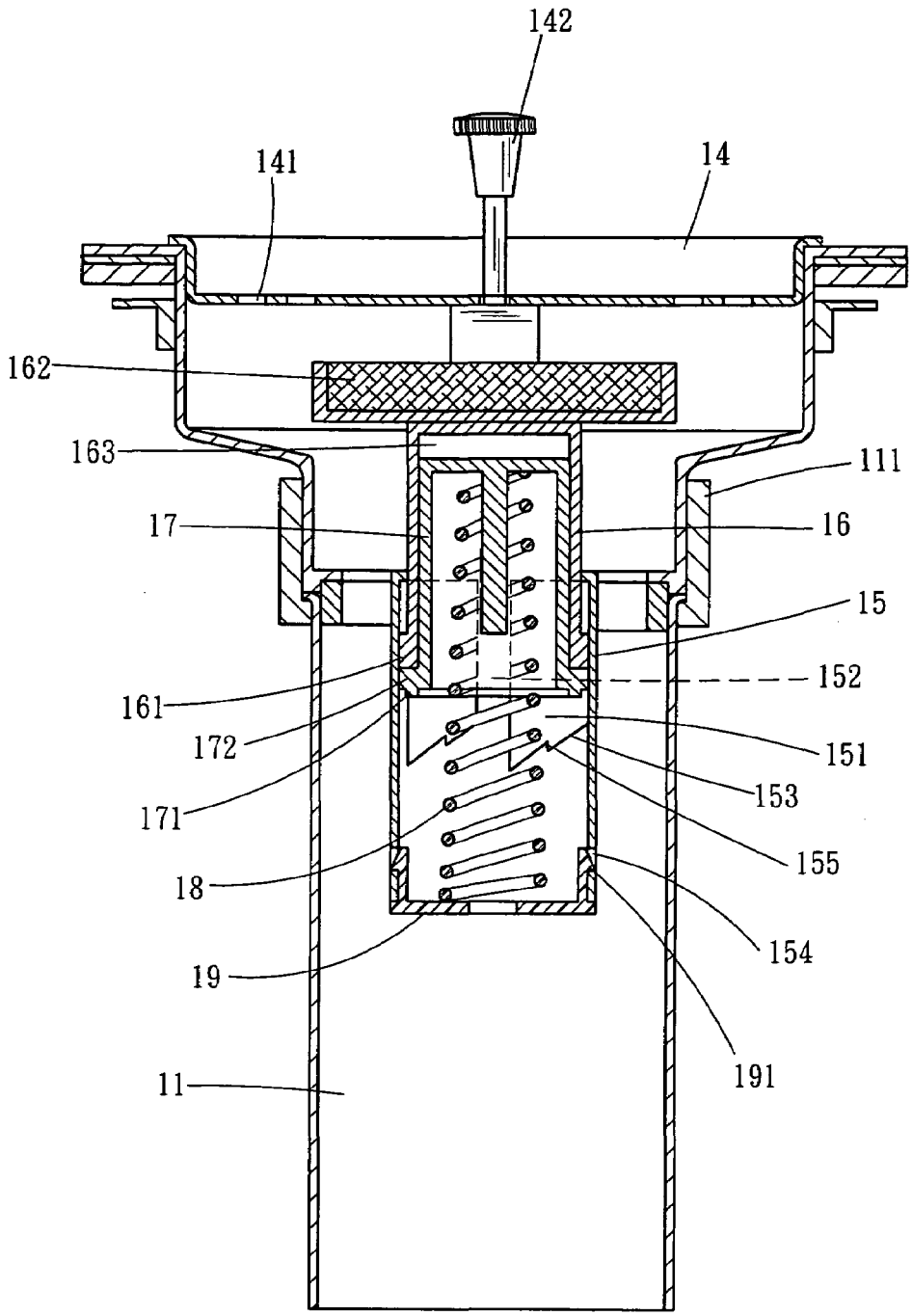
FIG. 5A is a sectional view of an embodiment of the present invention.

Refer to FIG. 5A, a hollow tube 15 is coupled on the bottom of the water collector 12 and housed in the duct 11. The tube 15 has four bulged and longitudinal walls 151 on the inner perimeter that are spaced from one another to form a flute 152 between every two neighboring bulged walls 151. The bulged wall 151 further has an arched guiding section 153 on the bottom. The guiding section 153 has an indented wedged notch 155 in the middle directing downwards. The tube 15 has four latch holes 154 on the perimeter of the bottom thereof.

An extendable rod 16 is housed in the tube 15 from the lower portion to the upper portion. The rod 16 has lugs 161 on the outer wall of the bottom corresponding to the flutes 152, and a top end fastened to a plug 162 which may be inserted into the drain port 13 of the water collector 12 (referring to FIG. 5B). The bottom of the extendable rod 16 has a housing chamber 163.

There is a cylindrical latch member 17 with the top section housed in the housing chamber 163, and a flange 171 on the bottom. The flange 171 has four coupling sections 172 of the perimeter. The coupling sections 172 have a slanted top end.

An elastic element 18 such as a conical spring is provided and has the top end housed in the hollow interior of the latch member 17 and the bottom end fastened to a coupling member 19.

The coupling member 19 is made from plastics and has four latch hooks 191 on the perimeter of the top end thereof depressible inwards to couple with the latch holes 154 of the tube 15 for anchoring.

Figure 5B:
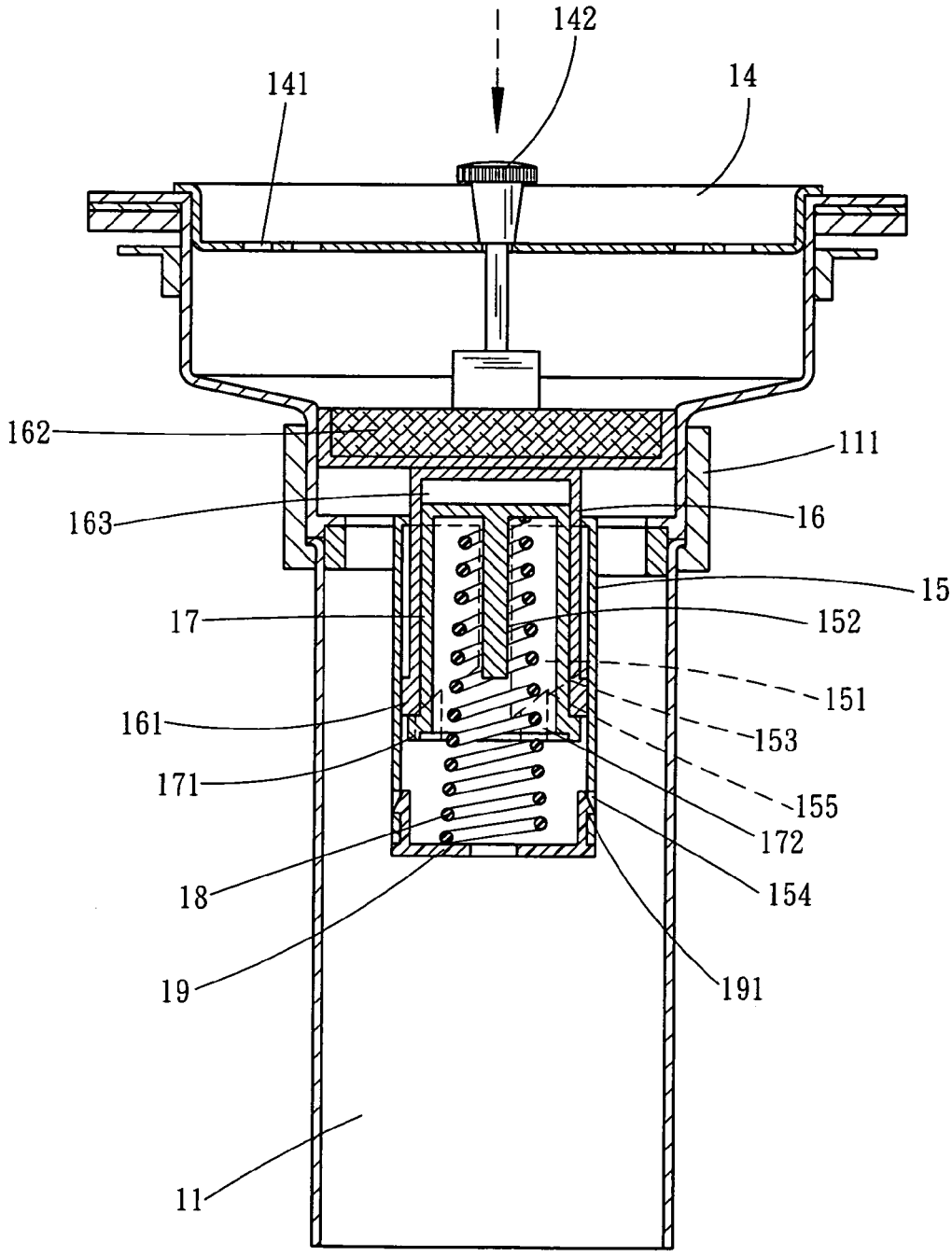
FIG. 5B is a sectional view of an embodiment of the present invention in an operating condition according to FIG. 5A.
Figure 6:
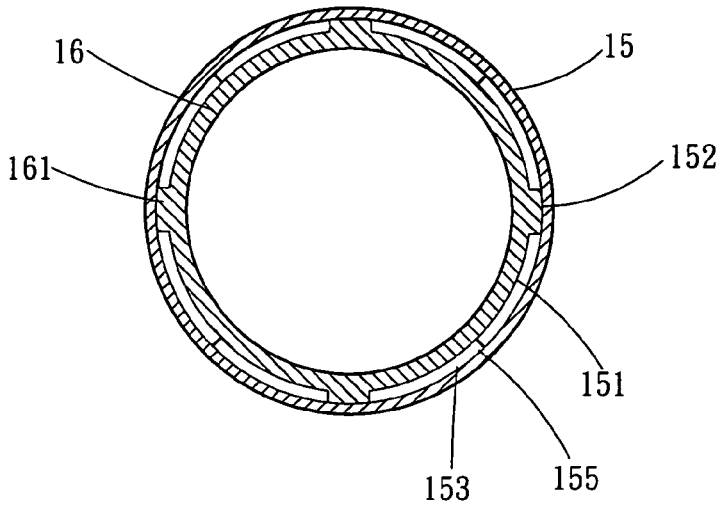
FIG. 6 is a transverse cross section of the tube of the invention.
Figure 7:
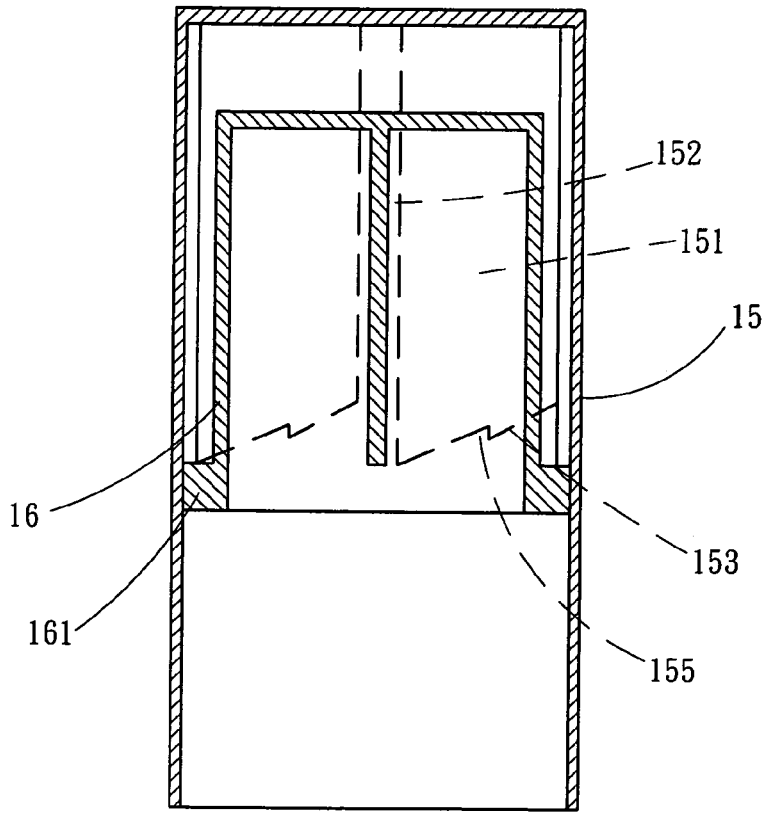
FIG. 7 is a longitudinal cross section of the tube of the invention.

Refer to FIGS. 5A and 5B, by means of construction set forth above, when in use for collecting water in the sink, depress the button 142 in the center of the filter 14, the plug 162 is moved downwards, and the extendable rod 16 also is pushed downwards at the same time. Consequently, the latch members 17 are moved downwards, and the elastic element 18 is compressed. The four coupling sections 172 are pushed downwards by the lugs 161 of the extendable rod 16 to the bottom of the flutes 152 and turn because of the arched guiding section 153 of the bulged inner wall 151. Referring to FIGS. 6 and 7, when the depressing force on the button 142 is released, the coupling sections 172 are engaged with the wedged notches 155 and anchored so that the plug 162 seals the drain port 13 of the water collector 12 to retain water for cleansing use.

After use of the water is finished, and the used water is to be discharged, depress the button 142 again, the coupling sections 172 of the latch member 17 are turned again to escape the wedge notches 155 and are aligned with the flutes 152. Hence when the depressing force is released, the returning force of the elastic element 18 pushes the latch member 17 upwards and moves the extendable rod 16 upwards at the same time, and the plug 162 on the upper end of the extendable rod 16 is moved upwards to escape the drain port 13 to allow the used water to be discharged.

As the filter 14 for filtering out the leavings is located in the water collector 12 in normal conditions, and the button 142 to control water collection and discharge is located in the center of the filter 14, the elements for controlling water collection or discharge can be prevented from losing. In addition, operation of water collection or discharge is simple and convenient. It offers significant improvements over the conventional strainers.

What is claimed is:

1. A strainer, comprising:

a body;

a water collector located on a upper side of the body having an opening directing upwards and a drain port on the bottom connecting to a duct located therebelow;

a filter having a plurality of drain apertures on the bottom and a button formed in a strut in the center movable up and down;

a hollow tube coupled on the bottom of the water collector having a plurality of longitudinal and bulged walls on the inner perimeter that are spaced from one another to form a flute between every two neighboring bulged walls, each bulged wall having an arched guiding section on the bottom thereof, the guiding section having an indented wedged notch directing downwards;

an extendable rod housed in the tube having lugs on the perimeter of the bottom thereof corresponding to the flutes;

a plug fastened to the top end thereof engageable with the drain port and a round housing chamber formed on the bottom thereof;

a latch member formed in a strut having a top end housed in the housing chamber and coupling sections corresponding to the lugs that have a slanted top end; and an elastic element having a top end housed in the latch member and a bottom end fastened to a coupling member.

2. The strainer of claim 1, wherein the bulged walls have four sets on the inner perimeter of the tube, the tube having four latch holes on the perimeter of the bottom thereof, the coupling member being made from plastics and having four latch hooks on the perimeter of the top end thereof engageable with the latch holes.

3. The strainer of claim 1, wherein the elastic element is a conical spring.

4. The strainer of claim 1, wherein the filter is a tray.

* * * * *